US005177543A

United States Patent [19]

Rodenberg et al.

[11] Patent Number: 5,177,543

[45] Date of Patent: Jan. 5, 1993

[54] DETACK ENHANCEMENT FOR ELECTROSTATOGRAPHIC DOCUMENT COPIERS/PRINTERS

[75] Inventors: Orville C. Rodenberg; George R. Walgrove, III; David L. Dunaway, all of Rochester, N.Y.

[73] Assignee: Eastman Kodak Company, Rochester, N.Y.

[21] Appl. No.: 722,803

[22] Filed: Jun. 28, 1991

[51] Int. Cl.[5] ..... G03G 15/14

[52] U.S. Cl. ..... 355/271; 355/315; 355/325; 355/326

[58] Field of Search ..... 355/271, 273, 274, 275, 355/315, 311, 325, 217, 208, 245; 118/653; 430/42, 44

[56] References Cited

U.S. PATENT DOCUMENTS

| | | | |
|---|---|---|---|
| 4,353,648 | 10/1982 | Tanaka et al. | 355/315 X |
| 4,420,244 | 12/1983 | Landa | 355/274 |
| 4,928,136 | 5/1990 | Kusumoto et al. | 355/315 |
| 4,949,128 | 8/1990 | Parsons | 355/271 |
| 5,053,818 | 10/1991 | Smith | 355/311 X |

FOREIGN PATENT DOCUMENTS

| | | | |
|---|---|---|---|
| 2-93572 | 4/1990 | Japan | 355/274 |
| 8801404 | 2/1988 | World Int. Prop. O. | 355/325 |

*Primary Examiner*—A. T. Grimley
*Assistant Examiner*—Shuk Y. Lee
*Attorney, Agent, or Firm*—David A. Howley

[57] ABSTRACT

An electrostatographic copier/printer has an image member with at least one portion which can selectively be imaged to receive an electrostatic image to be toned. A toning station is operable to bring the developer into contact with the image member portion so as to produce a toner image according to the electrostatic image if the portion has been imaged and to leave a small amount of background toner uniformly deposited if the image member portion has not been imaged. The background toner on the non-imaged portion serves to assist subsequent detack operation. A plurality of different color toning stations may be provided, and, if so, the black toner toning station is preferably used to leave the background toner.

5 Claims, 2 Drawing Sheets

DETACK ENHANCEMENT FOR ELECTROSTATOGRAPHIC DOCUMENT COPIERS/PRINTERS

BACKGROUND OF THE INVENTION

1. Technical Field

This invention relates generally to electrostatographic copiers/printers, and more specifically the procedure for separating receiver sheets from the image member thereof. As used herein, the term "copiers/-printers" refers to copiers, printers, and copier-printer combinations.

2. Background Art

In a typical electrostatographic process, an electrostatic charge pattern having an image-wise configuration corresponding to information to be reproduced is formed on the surface of an image member. The charge pattern is developed by applying developer material to the pattern to form a transferable image on the image member. The developer material includes for example, thermoplastic pigmented marking particles which are attracted to the charge pattern by electrostatic forces.

Transfer of this image from the image member to a receiver sheet is accomplished by spraying negative charge on the receiver sheet using a transfer device such as a semi-conductive roller biased at a high potential. This negative charge on the receiver sheet after transfer either pairs with the positive charge of the toner on the image member or, in those areas which do not have an appreciable deposit of toner, couples mainly with its induced positive-polarity image charge in the conductive layer of the image member (FIG. 1). The negative charge in the non-image areas is beneficial in the sense that it electrostatically tacks the receiver sheet to the image member to better control its passage between the transfer station and the detack station, where the receiver sheet is separated from the image member before the image is permanently fixed to the sheet to form the reproduction.

Separation of the receiver sheet from the image member is referred to as the "detack" process. Detack is effected by means of a mechanical stripping pawl, by applying an electrical charge to remove any charge build up on the receiver sheet to lessen the force of attraction acting between the sheet and the image member, or both.

When separating a receiver sheet from the image member, the detack charger reduces the overall level of negative charge to a value where the receiver sheet is less tightly bound such that it can be more easily removed at the detack roller. The remaining negative charge, however, needs to still be great enough to hold the toner to the receiver sheet during and after separation of receiver sheet and image member. This requires a balanced situation between failure to detack and blow-off (transfer of toner back to the image member).

In most circumstances detack is successful, especially when there is appreciable image content or when there is a significant amount of toner near the lead edge of the receiver sheet. In this case, the toner more or less functions as a release agent, acting both electrically by coupling with the negative receiver charge, and physically as a spacer between the receiver sheet and image member. This has the net effect of reducing the adhesive and electrostatic binding force between receiver sheet and image member.

Some copier or printer jobs, however, require that receiver sheets be transported through the normal paper path even though an image is not written on the portion (frame) of the image member associated with that receiver sheet. Examples are spacer sheets to be inserted between transparencies, cover sheets for reports, separator sheets between chapters, etc. In this case, machine logic and software would not normally activate the development station because development need not take place. In order to keep the electrostatographic process and associated software as simple as possible but at the same time control the fate of the receiver sheet, the receiver sheet and image member are nevertheless allowed to experience the electric fields established by the transfer and detack subsystems, even though there is no toned image on the image member.

It has been found, however, when carrying out the above sequence of events, that blank receiver sheets do not detack as reliably as imaged sheets. When a blank receiver sheet is fed through the system and there is no toner on the image member, detack failures commonly occur. In this case, almost all of the transfer charge is coupled to any induced charge in the conductive layer of the image member. There is essentially no toner between receiver sheet and image member to reduce this binding force (FIG. 2). In this case, the normal amount of charge from the detack charger plus the beam strength of the receiver sheet is often insufficient to release the receiver sheet from the image member. The inability to detack reliably is even more apparent with lighter-weight receiver sheets having still lower beam strength.

One way of ensuring detack of blank receiver sheets is to increase the detack charger output and essentially neutralize all of the charge on the receiver sheet. This, however, would require a programmable power supply and the means to predict the arrival of blank receiver sheets.

DISCLOSURE OF INVENTION

It is an object of the present invention to provide improved detack performance for blank receiver sheets by in fact using the release properties of the toner itself. When developing an image, in addition to the toner that makes up the image, there is also a small amount of toner that is deposited in the background or non-image areas. These particles act as spacers between the receiver sheet and the image member. As small as they are, the particles are still large enough to sufficiently separate the receiver sheet and the image member. The separation provides an air gap which restricts the peak field to the Paschen limits which reduces the electrostatic force that binds the receiver sheet to the image member. Furthermore, physical separation minimizes any contact van der Walls forces that might exist (FIG. 3). Thus, even this small increase in air gap is great enough such that the normal detack charger setting will provide sufficient charge reduction to more reliably release the receiver sheet from the image member.

According to this object, the present invention provides that, even when there is no image to be developed, a toning station is gated such that the developer contacts the image member. This will, under normal operation, leave behind a small amount of background toner uniformly deposited on the image member, providing the necessary spacer particles to reduce electrostatic attraction between receiver sheet and image member, aiding detack.

In color apparatus, where there is a choice of development stations which could be used, various process and software considerations may dictate that the black station, if available, be used for the purpose of providing spacer particles to aid detack.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

Figure 1:
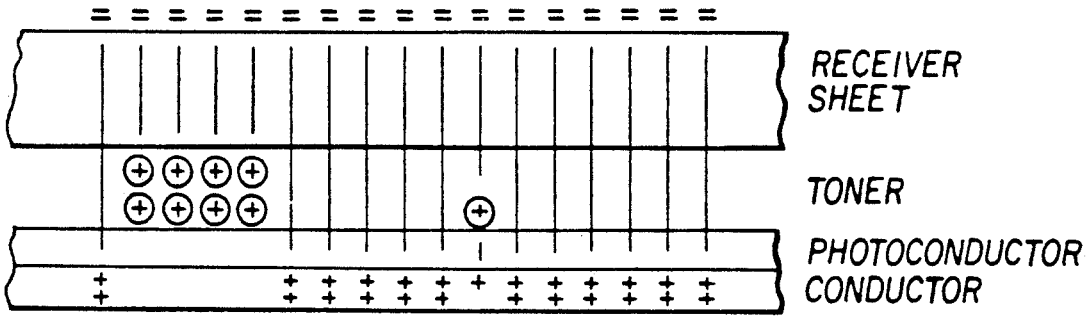
FIGS. 1–3 are cross-sectional views of a receiver sheet, an image member, and toner particles, further showing field charges thereon.
Figure 2:
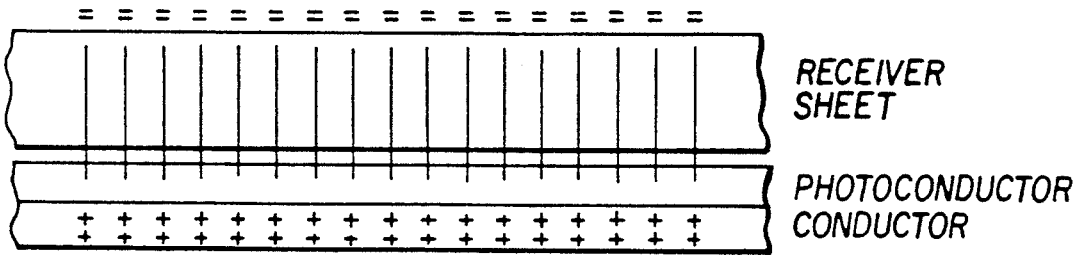
Figure 3:
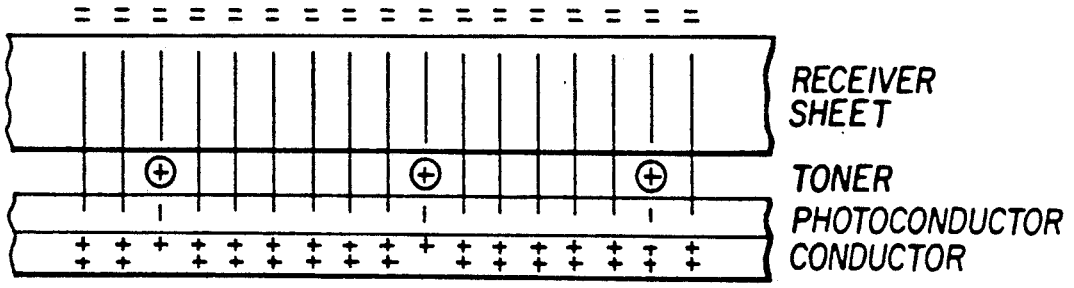
Figure 4:
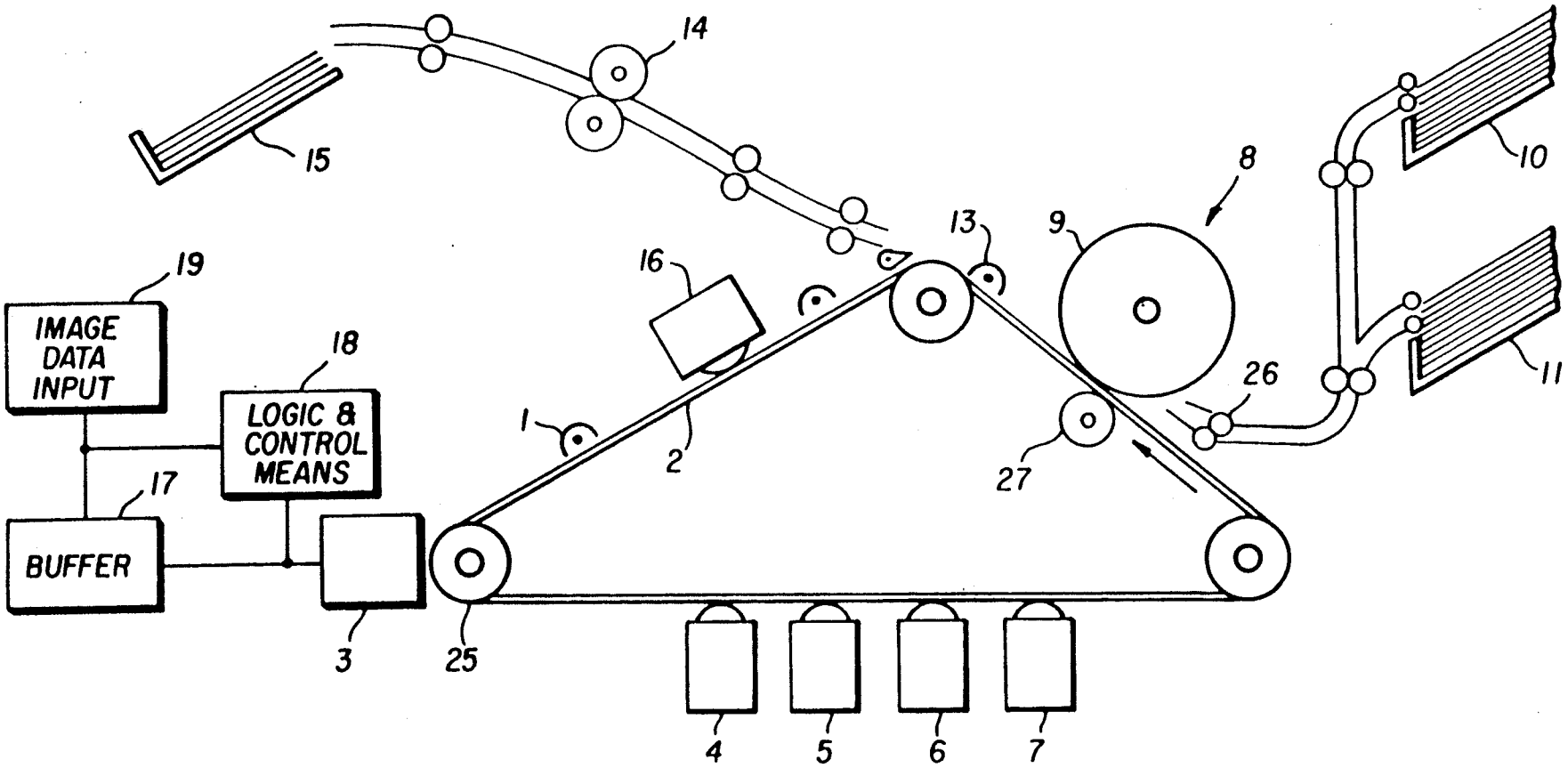
FIG. 4 is a schematic diagram of a multi-color electrostatographic copier/printer incorporating the present invention.

According to FIG. 4, an electrostatographic copier/-printer includes a charging mechanism 1 which places a uniform charge on an image member 2 such as an endless photoconductive web. An electronic exposure station 3 imagewise exposes the charged image member, creating an electrostatic image. Although exposure station 3 is shown as an electronic exposure station, it can also be an optical exposing station with minor variations in the schematic of FIG. 4. Typical electronic exposure stations can include, for example, laser scanning apparatus or an LED printhead, both structures being well known in the art.

Exposure station 3 responds to data fed from an image memory, such as for example buffer 17 which stores information representing images to be produced. The information stored in buffer 17 is received from an image data input 19 which can be a computer, a scanner, or the like. A logic and control unit 18 controls the storage of the image data in the buffer and the submission of the image data from the buffer to exposure station 3.

The electrostatic image created at exposure station 3 is toned by one of toner stations 4, 5, 6, and 7. The toned image is then transferred to a receiver sheet by a transfer apparatus 8 which includes a drum 9 and a backup drum 27.

Receiver sheets are fed from supplies 10 or 11 through rollers 26 to the transfer apparatus. After the toner image is transferred to the receiver sheet, the sheet is stripped from image member 2 at a separation station including a corona 13. The receiver sheets are transported by rollers and guides to a fuser 14 and then to a hopper 15. Image member 2 is cleaned for reuse at a cleaning station 16.

One popular medium for communicating information involves displaying the desired information on a projection screen. Such information is contained on sheets of transparency material, and is projected therefrom onto the screen. Transparencies, however, have proven difficult to handle during use, as they tend to stick together. The solution to this problem has commonly been to interleave plain paper separator sheets between adjacent transparencies. The separator sheets may be blank or may contain the same information as the adjacent transparency.

According to commonly assigned U.S. Pat. No. 4,681,428, transparencies may be provided in one of the supplies 10 and 11 of FIG. 4 and separator sheets in the other supply. From the two supplies, transparencies and separator sheets may be interleaved. Alternatively, one of the supplies 10 and 11 may contain paper sheets of one characteristic (color) and the other supply may contain sheets of another characteristic to be used as, say, chapter inserts.

As discussed above, receiver sheets which are intended to be left blank to be used as separator sheets between transparencies, cover sheets, separator sheets between chapters, etc. present detack problems. According to the present invention, detack performance of blank receiver sheets is improved by making use of the release properties of the toner itself. When a non-imaged portion (frame) of image member 2 passes toner stations 4–7, at least one of the toner stations is gated such that the developer contacts the image member. This leaves a small amount of background toner uniformly deposited on the image member.

The background toner particles act as spacers between the receiver sheet and the image member; providing an air gap which reduces the electrostatic attraction between the receiver sheet and the image member.

It has been found that by developing a background image on otherwise non-imaged frames of the image member, detack is enhanced sufficiently that normal detack charger settings provide sufficient charge to reliably release the receiver sheet from the image member.

In copiers/printers having a plurality of different color toning stations, process and software considerations may make it preferable to use the black station, if any, for providing the background development. If the non-imaged frame associated with a blank sheet is adjacent to a color separation frame of another receiver which is to be toned in a color other than black, it may be appropriate to use the same, non-black station to provide the background development.

The invention has been described in detail with particular reference to preferred embodiments thereof, but it will be understood that variations and modifications can be effected within the spirit and scope of the invention.

What is claimed is:

1. An electrostatographic copier/printer comprising:

an image member having at least one portion which can selectively be imaged to receive an electrostatic image to be toned;

a toning station operable to bring the developer into contact with the image member portion so as to produce a toner image according to the electrostatic image if the portion has been imaged and to leave a small amount of background toner uniformly deposited if the image member portion has not been imaged;

a transfer station operable to move the toner from the image member to a receiver sheet; and a detack station operable to separate the receiver sheet and transferred toner from the image member.

2. An electrostatographic copier/printer as set forth in claim 1 wherein:

said transfer station comprises means for subjecting receiver sheets to electric fields to assist in the movement of toner from the image member to the receiver sheet, whether or not the associated portion of the image member has been imaged.

3. An electrostatographic copier/printer as set forth in claim 1 wherein:

a plurality of toning stations are provided, each station containing a different color toner and one of the colors is black; and means are provided to use the black toner toning station to leave the small amount of background toner when the image member portion has not been imaged.

4. An electrostatographic copier/printer comprising:

an image member;

means for selectively image-wise exposing a frame of said image member to create an electrostatic latent image;

means for contacting the image member with toner developer so as to produce a toner image according to the electrostatic latent image if the frame has been image-wise exposed and to leave a small amount of background toner uniformly deposited if the frame has not been image-wise exposed;

means for transferring the toner from the image member to a receiver sheet; and means for separating the receiver sheet and transferred toner from the image member.

5. A process for producing electrostatographic images on a copier/printer having an image member, said process comprising:

selectively image-wise exposing a frame of said image member to create an electrostatic latent image;

contacting the image member with toner developer so as to produce a toner image according to the electrostatic latent image if the frame has been image-wise exposed and to leave a small amount of background toner uniformly deposited if the frame has not been image-wise exposed;

transferring the toner from the image member to a receiver sheet; and separating the receiver sheet and transferred toner from the image member.

* * * * *